US009670054B2

(12) United States Patent
Ozawa et al.

(10) Patent No.: US 9,670,054 B2
(45) Date of Patent: Jun. 6, 2017

(54) STUFFED ARTICLE

(75) Inventors: Ichiro Ozawa, Osaka (JP); Hirokazu Onishi, Ehime (JP); Ippei Yamauchi, Osaka (JP); Kazunobu Ishikawa, Hiroshima (JP)

(73) Assignees: Kurashiki Boseki Kabushiki Kaisha, Okayama (JP); Ishiken Kabushiki Kaisha, Hiroshima (JP)

( * ) Notice: Subject to any disclaimer, the term of this patent is extended or adjusted under 35 U.S.C. 154(b) by 0 days.

(21) Appl. No.: 13/816,878

(22) PCT Filed: Aug. 22, 2011

(86) PCT No.: PCT/JP2011/068874

§ 371 (c)(1),
(2), (4) Date: Feb. 13, 2013

(87) PCT Pub. No.: WO2012/026424

PCT Pub. Date: Mar. 1, 2012

(65) Prior Publication Data

US 2013/0136892 A1 May 30, 2013

(30) Foreign Application Priority Data

Aug. 23, 2010 (JP) ..... 2010-186014
Apr. 13, 2011 (JP) ..... 2011-089361

(51) Int. Cl.
*B68G 11/03* (2006.01)
*B68G 7/02* (2006.01)
(Continued)

(52) U.S. Cl.
CPC ..... *B68G 11/03* (2013.01); *A47C 27/12* (2013.01); *A47G 9/02* (2013.01); *A47G 9/0207* (2013.01);
(Continued)

(58) Field of Classification Search
CPC ..... B68G 11/00; B68G 11/02; B68G 11/03
See application file for complete search history.

(56) References Cited

U.S. PATENT DOCUMENTS 2,217,621 A 10/1940 Katzner
3,410,077 A * 11/1968 Alfred Marzocchi et al. . 57/227
(Continued)

FOREIGN PATENT DOCUMENTS

CH 292 739 8/1953
CN 1202088 12/1998
(Continued)

OTHER PUBLICATIONS

Office Action issued for Japanese Patent Application No. 2011-089361, mailed Feb. 5, 2015.

*Primary Examiner* — David Sample
*Assistant Examiner* — Donald M Flores, Jr.
(74) *Attorney, Agent, or Firm* — Hamre, Schumann, Mueller & Larson, P.C.

(57) ABSTRACT

This stuffed article (1) of the present invention is made of ticking (2*a*, 2*b*) filled with a stuffing. The stuffing is a long-fiber wad (8) formed by integrating an effect yarn with a core yarn. The effect yarn is opened to form loop-like fibers. A plurality of strings of the long-fiber wad (8) are arranged in parallel in at least one direction, and sewn to the ticking so as to be integrated with the ticking. The long-fiber wad in the stuffed article is fixed to the ticking, and the effect yarn is integrated with the core yarn. Therefore, the present invention can provide a stuffed article where the displacement of the long-fiber wad is limited even after repeated washing, the wad is less concentrated, and the bulkiness is high.

15 Claims, 10 Drawing Sheets

(51) Int. Cl.

| | |
|---|---|
| ***A47C 27/12*** | (2006.01) |
| ***A47G 9/02*** | (2006.01) |
| ***D02G 3/34*** | (2006.01) |
| ***B68G 7/00*** | (2006.01) |

(52) U.S. Cl.

CPC ..... *B68G 7/00* (2013.01); *B68G 7/02* (2013.01); *D02G 3/34* (2013.01); *Y10T 29/481* (2015.01); *Y10T 428/24132* (2015.01)

(56) References Cited

U.S. PATENT DOCUMENTS

| | | | | |
|---|---|---|---|---|
| 3,596,459 | A * | 8/1971 | Wada et al. | 57/6 |
| 3,905,057 | A * | 9/1975 | Willis et al. | 428/119 |
| 4,024,700 | A * | 5/1977 | Drummond | 57/227 |
| 4,555,421 | A | 11/1985 | Yasue | |
| 5,298,321 | A | 3/1994 | Isoda et al. | |
| 6,115,859 | A | 9/2000 | Ozawa | |
| 7,127,784 | B2 * | 10/2006 | Goineau | D02G 3/32 28/219 |
| 2005/0158543 | A1 * | 7/2005 | Lee | D02G 1/161 428/373 |
| 2005/0262646 | A1 * | 12/2005 | Berlinger | D06M 23/12 8/186 |
| 2006/0223400 | A1 | 10/2006 | Yasui et al. | |

FOREIGN PATENT DOCUMENTS

| | | |
|---|---|---|
| CN | 1756864 | 4/2006 |
| CN | 101117745 | 2/2008 |
| CN | 201459318 | 5/2010 |
| DE | 315 265 | 10/1919 |
| DE | 27 17 495 | 11/1978 |
| EP | 1 640 488 | 3/2006 |
| JP | 55-158366 | 12/1980 |
| JP | 58-146385 | 8/1983 |
| JP | 58-173579 | 10/1983 |
| JP | 58-206789 | 12/1983 |
| JP | 62-004239 | 1/1987 |
| JP | 62-092765 | 6/1987 |
| JP | 63-196732 | 8/1988 |
| JP | 64-003511 | 1/1989 |
| JP | 4-033239 | 6/1992 |
| JP | 6-093513 | 4/1994 |
| JP | 6-154438 | 6/1994 |
| JP | 7-112503 | 5/1995 |
| JP | 8-296132 | 11/1996 |
| JP | 10-245732 | 9/1998 |
| JP | 2001-214338 | 8/2001 |
| JP | 2005-143567 | 6/2005 |
| JP | 2009-052183 | 3/2009 |
| WO | 2006/104010 | 10/2006 |
| WO | 2007/088758 | 8/2007 |
| WO | WO 2007088758 A1 * | 8/2007 |

* cited by examiner

Comparative Example 1 Example 1

Comparative Example 2 Example 2

Comparative Example 3 Example 3

Comparative Example 4 Example 4

Comparative Example 5 Example 5

Comparative Example 6 Example 6

STUFFED ARTICLE

TECHNICAL FIELD

The present invention relates to a stuffed article using a long-fiber wad prepared by arranging in parallel in at least one direction a large number of long fibers including an effect yarn integrated with a core yarn.

BACKGROUND ART

For downs used for filling down products such as down comforters/quilts and down jackets, plumage of water birds is used in general. Examples of water birds include a goose, a duck and an eider (wild duck) that inhabits coastal areas around the Arctic Circle. The plumage is classified into down that covers the breast of a bird and feather, both of which are used for down products. Such plumage is produced in Central Europe such as Poland and Hungary, Northern Europe including the Scandinavian Peninsula, China and the like. Down is bulky and warm, and thus it is highly prized as a high-class material for down products like comforters/quilts and down jackets.

However, as the supply of natural plumage depends on water birds, the supply is limited and furthermore, the supply fluctuates under the influences of natural conditions and/or disasters and diseases (e. g., avian viruses). Also, capture of wild birds is limited from the viewpoint of protecting the natural environment. In addition to that, natural plumage will have an offensive odor if it is washed insufficiently. Therefore, it is required that dirt causing a bad smell be removed in advance and the plumage is kept under control for maintaining a certain level of cleanliness and oxygen count. A further problem is that such products of plumage like a down comforter/quilt and a down jacket cannot be washed easily.

In light of such problems, many proposals have been made for the wad. Patent document 1 proposes bending staples to be looped and fixing the staples at any overlapping points. Patent document 2 proposes air-entangling a core fiber and a loop fiber by use of an air nozzle and then fusing the fibers. Patent document 3 proposes shrinking a polyester fiber by heating so as to develop crimping, thereby providing the fiber with bulkiness and elasticity. Patent document 4 proposes binding untwisted staples with low-melting-point fibers and fusing. The Applicants propose in Patent document 5 a wad composed of a core yarn and an effect yarn, in which the core yarn is fused.

PRIOR ART DOCUMENTS

Patent Documents

Patent document 1: JP S55 (1980)-158366
Patent document 2: JP S58 (1983)-146385
Patent document 3: JP H06 (1994)-93513
Patent document 4: WO 2006/104010 A1
Patent document 5: JP 2009-52183

DISCLOSURE OF INVENTION

Problem to be Solved by the Invention

The Inventors have found problems in the above-mentioned Patent documents. Namely, in the examples of Patent documents 1 and 4 where staples are used for the effect yarns, the stuffing will be concentrated in a place upon washing, and the bulkiness will deteriorate soon, that is, the duration in bulkiness is inferior. In a method of Patent document 2 of fusing by a simple air entanglement, sufficient bulkiness cannot be achieved. Similarly, in a case where bulkiness is developed by only crimping of the fiber itself as in Patent document 3, the stuffing will be concentrated in a place upon washing, and the bulkiness will deteriorate soon, that is, the duration in bulkiness is inferior. For these reasons, only card-opened cotton has been put into practical use. The wad proposed in Patent document 5 is soft, but wash resistance is inferior, namely, the wad will be concentrated in a place due to washing.

For solving the above-mentioned problems, the present invention provides a stuffed article that is bulky and excellent in wash resistance.

Means for Solving Problem

A stuffed article of the present invention is a stuffed article formed by filling ticking with a stuffing, wherein the stuffing is a long-fiber wad formed by integrating an effect yarn with a core yarn, the effect yarn is opened to form loop-like fibers, and a plurality of strings of the long-fiber wad are arranged in parallel in at least one direction and sewn to the ticking to be integrated with the ticking.

Examples of the stuffed article of the present invention include: a comforter/mattress, a blanket, a sleeping bag, a pillow, a cushion, a mat, a stuffed toy, a leg sheet, a jacket, pants, a vest, a coat, cold-protection clothing, and a neck-warmer.

Effects of the Invention

A stuffed article of the present invention is a stuffed article formed by filling ticking with a stuffing, wherein the stuffing comprises a long-fiber wad formed by integrating an effect yarn with a core yarn, the effect yarn is opened to form loop-like fibers, and a plurality of strings of the long-fiber wad are arranged in parallel in at least one direction and sewn to the ticking to be integrated with the ticking. Thereby, a stuffed article that is bulky and excellent in wash resistance can be provided. Namely, since in the stuffed article of the present invention, a long-fiber wad is fixed to the ticking and furthermore since the effect yarn is integrated with the core yarn, displacement of the long-fiber wad is limited even after repeated washing, and thus a bulky stuffed article with less concentration of the wad can be provided.

DESCRIPTION OF THE INVENTION

Figure 1:
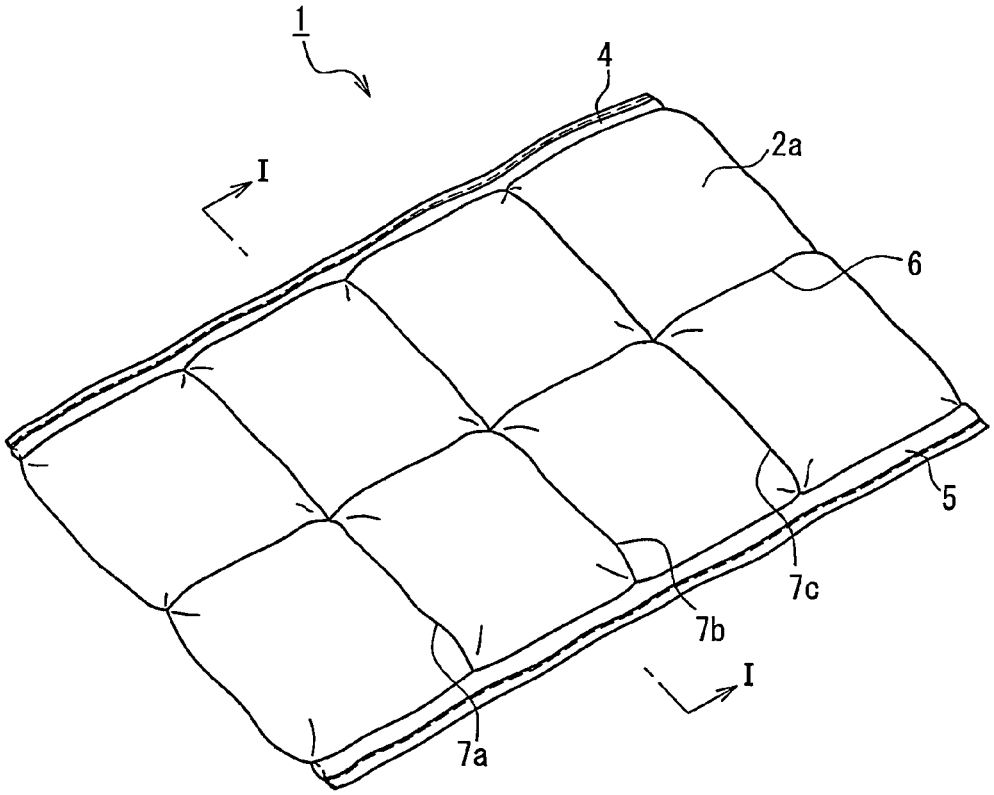
FIG. 1 is a perspective view showing a comforter in one example of the present invention.

The long-fiber wad used in the present invention is formed by integrating an effect yarn with a core yarn, and the effect yarn is opened to form loop-like fibers. Thereby, a bulky stuffing can be obtained. In the present invention, the expression "integrating an effect yarn with a core yarn" indicates that the monofilaments composing the effect yarn and the core yarn are entangled with each other. The monofilaments are not necessarily fused and fixed to each other, though they may be fused and fixed to each other. The expression "the effect yarn is opened to form loop-like fibers" indicates that the yarn may be opened at the same time of air entanglement, or it may be opened in a separate opening step. The effect yarn and the core yarn can be integrated with each other by twisting the effect yarn and the core yarn together or by entangling the effect yarn and the core yarn. It is also possible to prepare the loop-like fibers of a multifilament fiber as a long fiber. The loop-like fibers may be opened and fused with other. As the loop-like fibers are fused with each other, the bulkiness and the wash resistance can be improved. Namely, since the opened loop-like fibers are fused with each other, the number of fixing points increases and the bulkiness will be maintained for a long time Entanglement may be applied in place of or in addition to the fusion. The entanglement can be performed by entwining the monofilaments of the long fibers with each other by using an air nozzle. In addition to that, since strings of the long-fiber wad are arranged in parallel in at least one direction and sewn to the ticking so as to be integrated with the ticking, the filling material will not be concentrated in a place even after repeated washing.

In the present invention, the location at which the long-fiber wad and the ticking are sewn is not limited in particular as long as the wad is sewn together and integrated with the ticking. For example, the long-fiber wad and the ticking may be integrated by quilting (sewing) the both ends, the vicinities of the both ends and others. For example, in a case of a comforter/mattress, it is also possible to apply at least one quilting (sewing) at the center of the main surface so as to integrate the long-fiber wad with the ticking. In this manner, the wash resistance can be improved further. It is also possible that the long-fiber wad is integrally sewn at the both ends with ribbon-like strips and then formed to make a sheet of a long-fiber wad. Such a sheet can be used conveniently for filling inside the ticking, and thus improve handleability during a step of sewing with the ticking.

In a case where the effect yarn and/or the core yarn includes a fusible fiber, the fusible fiber of the effect yarn and the core yarn is preferably a conjugated fiber composed of at least two polymers having different melting points. For this conjugated fiber, a fiber of a sheath-core structure having a core of a high-melting point polymer and a sheath of a low-melting point polymer is preferred for the purpose of fusing the low-melting point polymer. Examples of the conjugated fiber of a sheath-core structure include "Bell-couple" manufactured by KB SEIREN LTD., "MELSET" manufactured by Unitika Ltd., and "EZBON" manufactured by Woongjin Chemical Co., Ltd. Such a conjugated fiber has a core of polyethylene terephthalate (PET) and its sheath is composed of a low-melting point polyester copolymer. Preferably the fusible fibers of the effect yarn and the core yarn are polyester multifilament fusible fibers, since polyester maintains its bulkiness for a long time Further, it is preferable that the fusible fibers have a fusion point in a range of 160° C. to 200° C. from the viewpoint of proccessability.

The effect yarn and/or the core yarn may include further an infusible fiber. Preferred examples of the infusible fiber are synthetic fibers such as polyester, nylon, polypropylene and the like. The percentages of the fusible fiber and the infusible fiber in the core yarn are, when the core yarn is 100 wt %, preferably the fusible fiber is 10 to 100 wt % and the infusible fiber is 0 to 90 wt %.

It is preferable that the average loop length of the loop-like fibers is in a range of 1 to 200 mm, and more preferably 5 to 50 mm, and further preferably 10 to 40 mm.

When the average loop length of the loop-like fibers is in the above-noted range, the texture, the bulkiness and the duration in bulkiness of the loop-like fibers can be improved further.

It is preferable that the monofilament fineness of the loop-like fiber (effect yarn) is in a range of 0.1 to 300 dtex and the total fineness is in a range of 10 to 600 dtex ('dtex' indicates deci tex). Further preferably the monofilament fineness is in a range of 1.0 to 50 dtex, and the total fineness is in a range of 20 to 250 dtex. Particularly preferably the monofilament fineness is in a range of 2.0 to 25 dtex, and the total fineness is in a range of 30 to 100 dtex. When the fineness is in the range, the bulkiness is maintained for a long time and the texture is favorable.

The core yarn may be constituted to include a conjugated fiber composed of two or more polymers having different melting points. An example of the conjugated fiber composed of two or more polymers having different melting points is a conjugated fiber including polymers having different melting points conjugated in a sheath-and-core structure. Specific examples include a sheath-core fiber where the high-melting point polymer is polypropylene polymer and the low-melting point polymer is polyethylene polymer or a low-melting point polypropylene polymer. A conjugated fiber composed of two or more polymers having different melting points may compose a core yarn by itself or may be combined with any other core yarn so as to compose a core yarn. From the viewpoint of integrating loop-like fibers more certainly, it is preferable that a sheath-core fiber is used in combination with a low-melting point thermal adhesive fiber yarn.

It is preferable that the difference in the melting point between the at least two kinds of core yarns having different melting points or the at least two polymers having different melting points is 10 to 200° C.

In a case of using an air-entangled yarn as the long-fiber wad, the effect yarn and the core yarn may be formed of infusible fibers. Preferred examples of the infusible fibers include synthetic fibers such as polyester, nylon, and polypropylene.

The preferable weight ratio of the loop-like fiber (effect yarn) to the core yarn is: the loop-like fiber (effect yarn) is 51 to 99% by weight (wt %) when the population parameter is the total of the loop-like fiber (effect yarn) and the core yarn. More preferably, the range is 80 to 98 wt %, and particularly preferably 85 to 97 wt %.

When the weight ratio is in the above-described range, fixing and integration with the core yarn is reliable, and the texture becomes favorable.

It is preferred that further a silicone-treatment agent is fixed by heat to the long-fiber wad. The preferred amount of the adhered silicone-treatment agent is in a range of 0.1 to 10 wt % with respect to the total amount of the loop-like fiber (effect yarn) and the core yarn. Further, acrylic resin, urethane resin and the like may be fixed to adjust the hardness.

The above-described long-fiber wad is composed of long fibers. Basically, the length can be in a range of several tens of centimeters to several hundreds of thousands of meters or more. At the time of being integrated with ticking, the fibers can be folded to the length of one side of the ticking, or may be cut to a predetermined length. There is no particular limitation on the direction to parallel the long-fiber wad. For example, in a case of a comforter, the wad can be arranged in parallel in any of the width direction (cross direction) and the length direction (longitudinal direction). In a case of a pillow, a length direction (longitudinal direction) is preferred. The weight per unit length of the long-fiber wad is preferably in a range of 0.01 to 3 g/m, more preferably in a range of 0.05 to 1.5 g/m. When the weight is in the above-described range, the wad can be produced easily and can be handled favorably.

Figure 2:
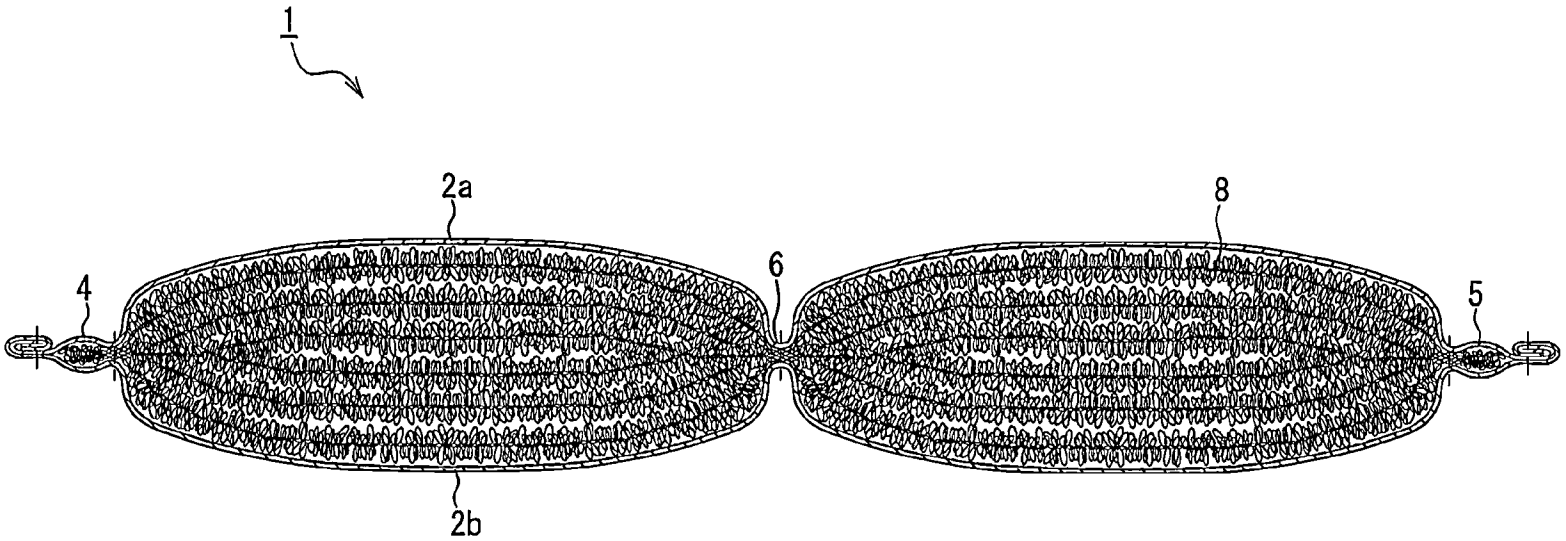
FIG. 2 is a cross-sectional view taken along a line I-I of FIG. 1.

Hereinafter the present invention will be explained with reference to the attached drawings. In the respective drawings, the identical reference signs indicate identical components. First, a comforter in one example of the present invention will be explained with reference to FIGS. 1-2. FIG. 1 is a perspective view of this comforter. A comforter 1 is formed of ticking 2 (2*a*), a long-fiber wad filled in the ticking, seam lines 4, 5 that are formed along the two longer sides of the ticking, a seam (quilt) line 6 formed at the substantial center along the length direction of the main surface (ticking) of the comforter 1, and seam (quilt) lines 7*a*-7*c* that cross the seam line 6. FIG. 2 is a cross-sectional view taken along a line I-I of FIG. 1, showing that a long-fiber wad 8 is fixed to the ticking 2*a*, 2*b* by the seam lines 4, 5, 6, 7*a*-7*c*. In FIGS. 1-2, not all of the seam (quilt) lines 4, 5, 6, 7*a*-7*c* are essential, but they can be omitted suitably.

Figure 3:
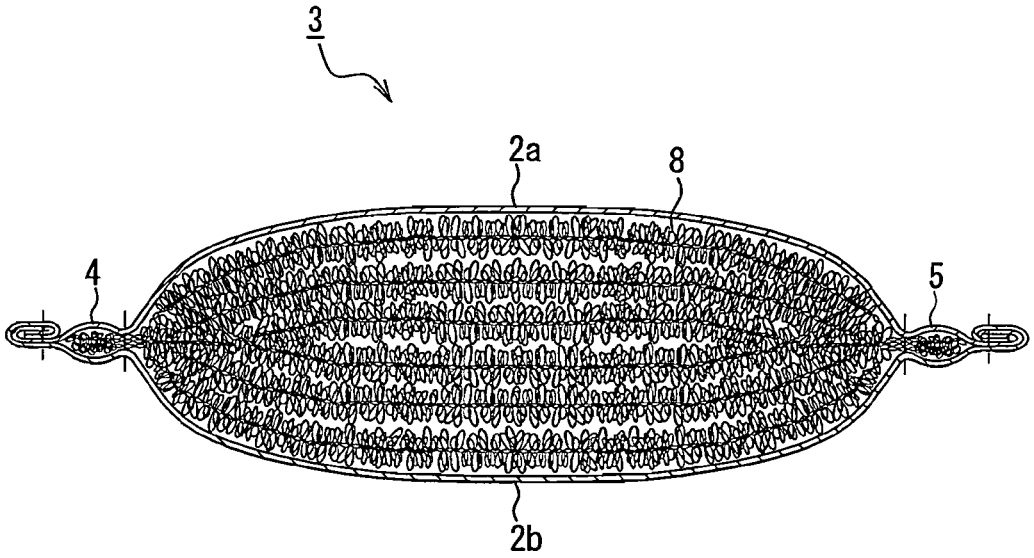
FIG. 3 is a cross-sectional view showing a pillow in one example of the present invention.

FIG. 3 is a cross-sectional view showing a pillow according to one example of the present invention. In this pillow 3, the long-fiber wad 8 is fixed to the ticking 2*a*, 2*b* by the seam lines 4, 5. In this example, there is no quilt line at the center.

Figure 4:
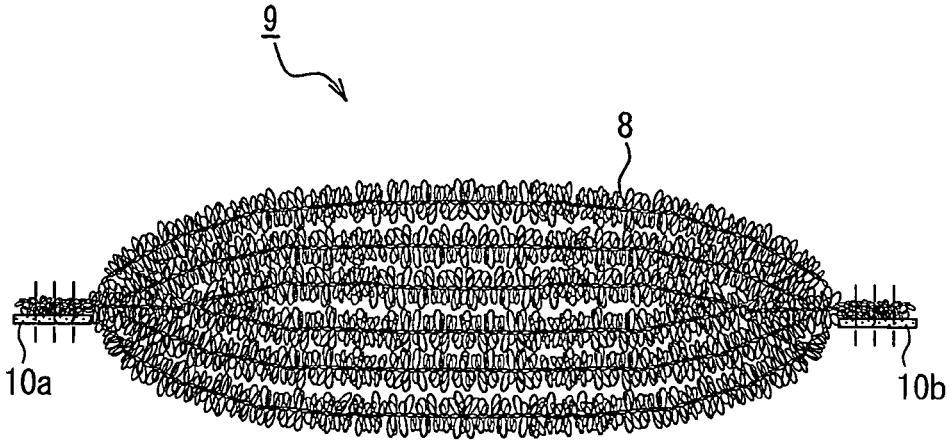
FIG. 4 is an explanatory view showing a cross section of a long-fiber wad in one example of the present invention, which is fixed at the both ends and formed to make a sheet.

FIG. 4 is an explanatory view showing fixing at the both ends of the long-fiber wad in one example of the present invention. The both ends of the long-fiber wad 8 are fixed in advance at ribbon-like strips 10*a*, 10*b* by sewing so as to shape a long-fiber wad sheet 9. Thereby, the long-fiber wad 8 can be integrated favorably and handled easily. In a case of a comforter/mattress, for filling inside the ticking in the state as shown in FIG. 4, the ticking is sewn in advance except one short side, and turned inside-out in order to sew the both ends of the ticking to the ribbon-like strips 10*a*, 10*b* of the long-fiber wad sheet 9. The ticking is then turned inside-out again so as to sew the short side that has been kept open. Alternatively, in a case of a similar comforter/mattress, ticking that has been sewn except for at one short side are filled with the long-fiber wad sheet 9 shown in FIG. 4, and the ticking and the ribbon-like strips are sewn to be fixed at both ends of the ticking. Later, the short side that has been kept open is sewn., and thereby a comforter/mattress is provided. In another method, many strings of the long-fiber wad 8 are arranged in parallel, and the both ends of each string of the long-fiber wad are aligned directly with the ends of the ticking, and fixed by sewing.

In the examples as shown in FIGS. 1-4, the long-fiber wad 8 may be cut to a predetermined length, or it may be looped of a predetermined length like a hank and folded at the both ends. In the sewn comforter 1 or the pillow 3, the long-fiber wad is fixed to the ticking, the length of the core yarn forming the long-fiber wad between the fixing points does not change, and furthermore, the effect yarn and the core yarn are integrated with each other. Therefore, even after repeated washing, the displacement of the long-fiber wad is limited, the wad is less concentrated, and the stuffing is bulky.

Figure 5:
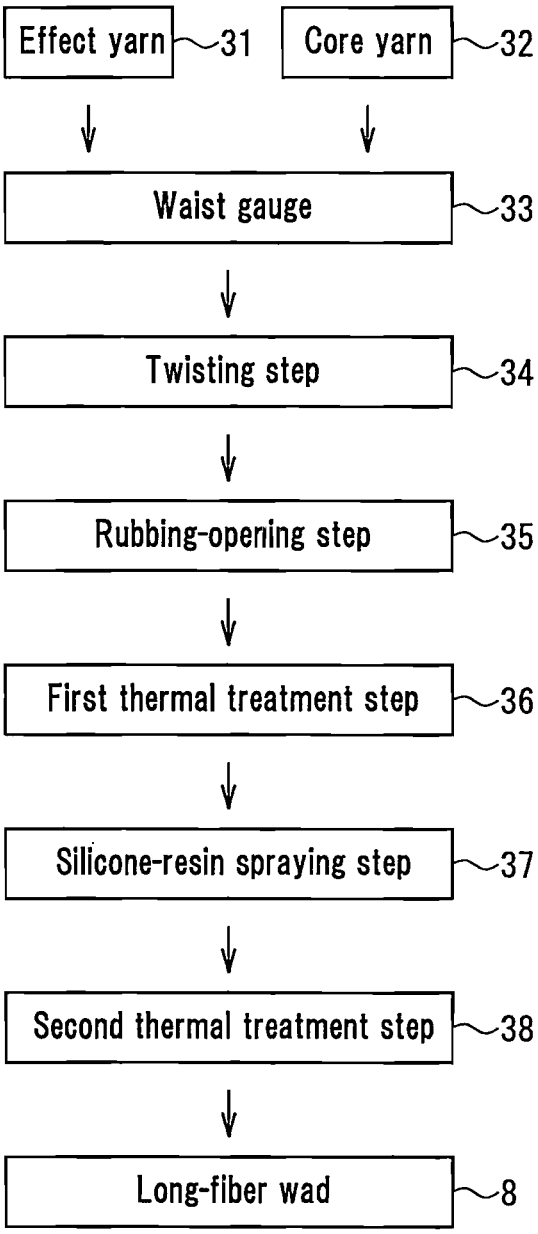
FIG. 5 is an explanatory view showing steps of manufacturing a long-fiber wad in one example of the present invention.

FIG. 5 is an explanatory view showing steps of manufacturing a long-fiber wad as one example of the present invention. As shown in FIG. 5, an effect yarn 31 and a core yarn 32 are fed to a waist gauge 33 and twisted in a twisting step 34. Next, the loop-like fibers of the effect yarn 34 are opened in a rubbing-opening step 35, and subsequently heated in a first thermal treatment step 36 so as to fuse at least a part of the loop-like fibers of the effect yarn, and also thermally fusing the fusible fibers of the core yarn so as to integrate the loop-like fibers. Next, in a silicone-resin spraying step 37, a silicone resin serving as a softener and a lubricating agent is sprayed, which is cured in a second thermal treatment step 38 so as to obtain the long-fiber wad 8 of the present invention.

Figure 6:
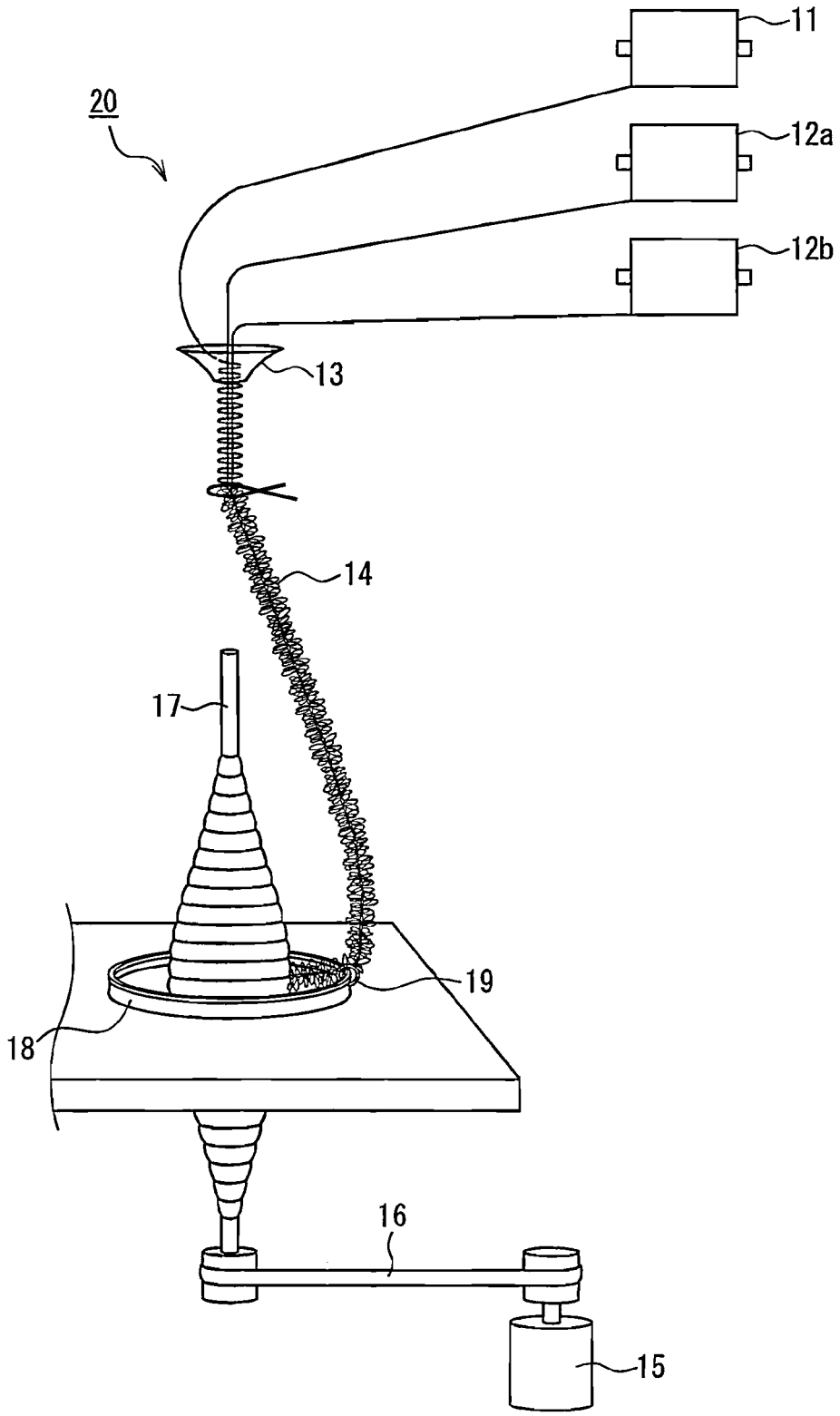
FIG. 6 is s schematic explanatory view showing a twisting step in one example of the present invention.
Figure 7:
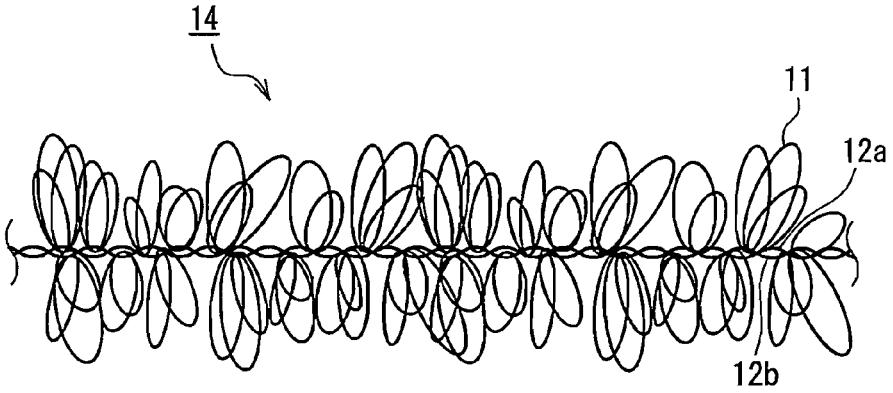
FIG. 7 is a magnified side view showing a loop yarn in the twisting step.

FIG. 6 is a schematic explanatory view of the twisting step in one example of the present invention. As shown in FIG. 6, the effect yarn 11 is fed to a waist gauge 13 in a rotating or swinging state, so that one kind of effect yarn or at least two kinds of core yarns 12*a*, 12*b* are fed to the waist gauge 13 so as to sandwich at least a part of the effect yarn 11. Here, the waist gauge is a funnel-shaped device, whose upper part is opened wide, into which a yarn can fall, while its bottom outlet is formed narrow so as to store the yarn temporarily. Next, the effect yarn 11 and the core yarns 12*a*, 12*b* are twisted together so as to form a loop yarn 14. The loop yarn 14 is subjected to an actual twisting by a twister 20. Specifically, a bobbin 17 is rotated by a motor 15 via a belt 16. A traveler 19 that is assembled with a ring 18 around the bobbin rotates after a time lag from the rotation of the bobbin 17, so that the loop yarn 14 passing through the traveler 19 is twisted actually. The preferred twisting number is 150 to 350 per meter. FIG. 7 is a magnified view showing the thus obtained loop yarn 14. The effect yarn 11 forms loops, while the core yarns 12*a*, 12*b* are spun for integrating the entire body.

Figure 8:
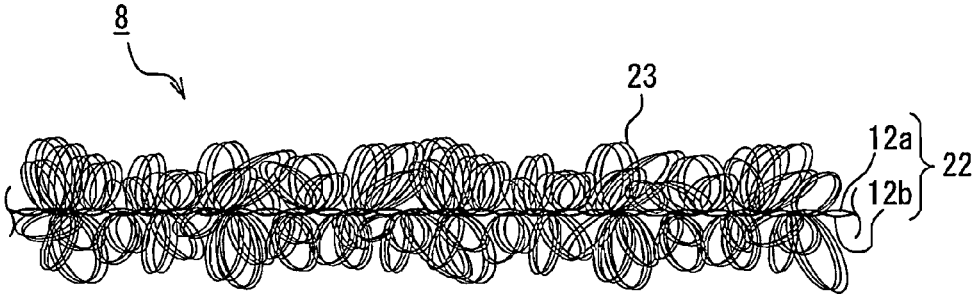
FIG. 8 is a schematic side view showing a long-fiber wad whose loop-like fibers have been opened in a rubbing-opening step in one example of the present invention.

The obtained loop yarn 14 is opened in the rubbing-opening step 35 as shown in FIG. 5. In this step, by rubbing two sheets of rubber, woven ticking, unwoven ticking, resin or the like, the loop yarn interposed between the sheets is rubbed, and opened to form loop-like fibers 23 as shown in FIG. 8. As a result of such an opening treatment, favorable bulkiness of about 40 mm or more for example can be obtained. Furthermore, for the effect yarn, hollow or high-strength polyester fibers are selected, which are subjected to an opening process. Or a polyester monofilament fiber of not more than 30 dtex is added to a multifilament fiber, which is then subjected to an opening treatment, thereby bulkiness of not less than 50 mm and about 150 mm can be developed. The method of opening fibers is not limited to rubbing but patting or brushing can be employed. Examples of rubbing members of a rubbing machine include: rubber (neoprene rubber, silicone rubber, urethane rubber, fluoro-rubber and the like), foams (urethane foam, silicone rubber foam, ethylene-vinyl alcohol (EVA)-based foam, cellulose-based rubber and the like), a woven ticking, a nonwoven ticking, artificial leather, and the like. In a case of brush-rubbing, the brush is made of synthetic fibers such as nylon, polyester, polyolefin, vinyl chloride, acrylics, aramid, fluoro-resins and the like; animal hair fibers such as sheep wool, horse hair, deer hair, pig hair and the like; and metal wires.

A loop yarn opened in the rubbing-opening step is unwound from the bobbin and thermally treated in the first thermal treatment step 36 shown in FIG. 5. Preferably, the thermal treatment temperature is 70 to 220° C. for example at which the fusible polymer of the loop yarn is fused, particularly 140 to 210° C., and the time for thermal treatment is 1 second to about 20 minutes. It is further preferable that a pressure of not less than 1 kg/cm$^2$ is applied. As a result of this first thermal treatment, the contacted portions of the opened loop-like fibers are fused. Since the loop-like fibers are concentrated at the core part, they are fused similarly. FIG. 8 shows the schematic cross-sectional view of the obtained long-fiber wad 8. In this drawing, 22 denotes a core yarn, and 23 denotes an opened loop-like fiber.

In a subsequent silicone-resin spraying step, a silicone resin is sprayed. For the silicone resin, a reactive silicone-treatment agent having a hydrogen group (—OH), a vinyl group (—CH═CH$_2$) and the like at the molecular terminal is used preferably.

For example, bulky silicone such as "TERON E 530" and soft silicone such as "TERON E 731" and "TERON E 722", all of which are manufactured by Matsumoto Yushi Seiyaku Co., Ltd., can be used. The preferred amount of the spray is 0.1 to 10 wt % with respect to the wad as weight in a dried state.

Figure 9:
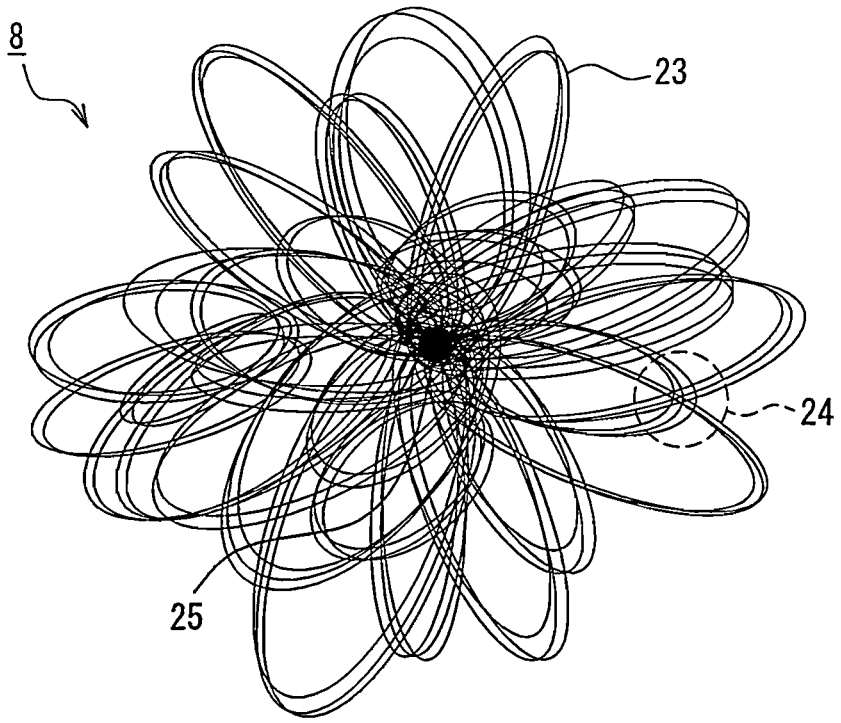
FIG. 9 is a schematic cross-sectional view showing a long-fiber wad obtained in the example of the present invention.

Next, in the second thermal treatment step, for example a thermal treatment is carried out at 120 to 200° C. for one second to about 20 minutes, thereby curing the silicone resin. The thus obtained long-fiber wad 8 is formed of opened loop-like fibers 23 and a core portion 25 at which the core yarns are thermally fused as shown in FIG. 9. Numeral 24 indicates a portion at which the loop-like fibers 23 are thermally fused with each other.

In a case of using an air-entangled yarn for the long-fiber wad, respectively one string of core yarn and one string of effect yarn are fed to two feed rollers of an air-entanglement device. The yarns are subjected to a combining-entangling treatment with an entanglement nozzle having an air pressure of 0.01 to 1.0 MPa, at a core yarn feeding rate of 10 to 200 m/min., an effect yarn feeding rate of 20 to 10000 m/min., and a winding rate of 10 to 200 m/min. Subsequently, the conjugated yarn having passed through a delivery roller is wound around a bobbin equipped with a ring-twisting mechanism, so that an air-entangled yarn can be obtained. And the thus obtained loop yarn (air-entangled yarn) is unwound from the bobbin and opened as required in the rubbing-opening step as shown in FIG. 5. In the rubbing-opening step, two sheets of rubber, woven ticking, unwoven ticking, resin and the like are rubbed with each other so that the loop yarn interposed between the sheets is rubbed and opened. Next, in the silicone-resin spraying step, a silicone resin is sprayed. For the silicone resin, a reactive silicone agent having a hydrogen group (—OH), a vinyl group (—CH═CH$_2$) and the like at the molecular terminal is used preferably.

Figure 10:
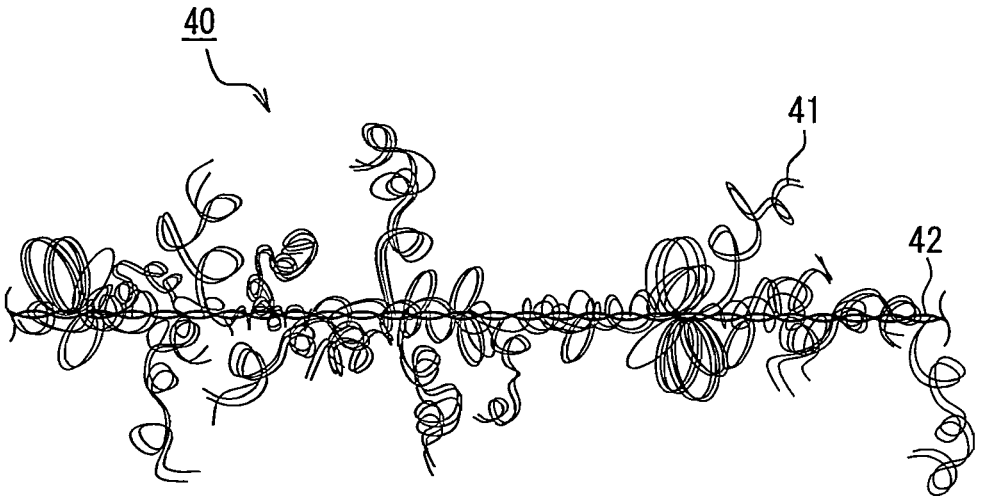
FIG. 10 is a magnified side view showing a loop yarn (air-entangled yarn) in one example of the present invention.

For example, bulky silicone such as "TERON E 530" and soft silicone such as "TERON E 731" and "TERON E 722", all of which are manufactured by Matsumoto Yushi Seiyaku Co., Ltd., can be used. The preferred amount of the spray is 0.1 to 10 wt % with respect to the wad as weight in a dried state. Next in a thermal treatment step, for example, a thermal treatment is carried out at 140 to 190° C. for 1 to 10 minutes, thereby curing the silicone resin. In a thus obtained long-fiber wad 40, as shown in FIG. 10, the fibers composing the core yarn 42 and the effect yarn 41 are entangled with each other, and the effect yarn 41 is opened to partly form loop-like fibers. In a case where the core yarn and/or the effect yarn includes a fusible fiber, the core yarn and the effect yarn can be fused and fixed at the time of curing. In this case, the effect yarn 41 that has been opened and to partly form the loop-like fibers and/or the core yarn 42 have fused portions.

The wad of the present invention is used suitably for a comforter/mattress, a sleeping bag, a pillow, a cushion, a mat, a stuffed toy, a leg sheet, a jacket, pants, a vest, a coat, cold-proof clothing, a neck warmer and the like.

EXAMPLES

The present invention will be described further specifically with reference to the examples below, although the present invention is not limited to the examples below.

Example 1

1. Core Yarn (1) Polyester fusible yarn: two strings of "EZBON" manufactured by Woongjin Chemical Co., Ltd. (conjugated multifilament fiber composed of a core of PET and a sheath of polyester copolymer; total fineness: 33 dtex; filament number: 24; straight yarn) were used.

(2) PET infusible yarn: two strings of straight yarns having a total fineness of 78 dtex and filament number of 48 were used.

2. Effect Yarn

Polyester fusible yarn: one string of "EZBON" manufactured by Woongjin Chemical Co., Ltd. (conjugated multifilament fiber composed of a core of PET and a sheath of polyester copolymer; total fineness: 33 dtex; filament number: 24; straight yarn) was used.

3. Manufacturing Apparatus

An apparatus as shown in FIG. 6 was used. The effect yarn was fed to a waist gauge 13 in a rotating or swinging state. In one example, the reciprocation distance would be about 40 mm in a case of swinging, and the loop at one side when picked up at the center of the loop would be about 20 mm in a case of rotation.

The core yarns and the effect yarn were used respectively as the core yarns 12*a*, 12*b* and the effect yarn 11, and the yarns were fed to the waist gauge 13. At this time, the core yarns 12*a*, 12*b* were fed to sandwich the loops of the effect yarn 11. Subsequently the effect yarn 11 and the core yarns 12*a*, 12*b* were twisted together to form the loop yarn 14. The loop yarn 14 was subjected to an actual twisting by the twister 20. The twisting number was 250 per meter. The obtained loop yarn 14 is shown in FIG. 7.

The obtained loop yarn 14 was unwound from the bobbin 17, and opened in the rubbing-opening step 35 shown in FIG. 5. In the rubbing-opening step, two sheets of rubber, woven fabric, unwoven fabric, resin or the like were rubbed with each other to rub the loop yarn interposed between the sheets, and thus the loop yarn was opened to make the loop-like fibers 23 as shown in FIG. 8.

Next, a thermal treatment was carried out in the first thermal treatment step 36 shown in FIG. 5. The thermal treatment temperature was 140 to 200° C., and the thermal treatment time was 0.5 to 10 minutes. As a result of this first thermal treatment, the polymers at the effect yarn 11 and the sheath portions of the core yarns 12*a*, 12*b* were fused, and the contact points of the loop-like fibers were fused. The core portions also were fused.

Next, in the silicone-resin spraying step 37, a silicone resin was sprayed. For the silicone resin, an aqueous solution of a mixture of three kinds of silicone, namely, bulky silicone such as "TERON E 530" and soft silicone such as "TERON E 731" and "TERON E 722", all of which are manufactured by Matsumoto Yushi Seiyaku Co., Ltd., were used. The amount of the spray was 3.0 wt % with respect to the wad as weight in a dried state. Next, in the second thermal treatment 38, a thermal treatment was carried out at 140 to 190° C. for 1 to 10 minutes, thereby curing the silicone resin.

The obtained long-fiber wad 8 included fused portions 24 at which opened loop-like fibers 23 were fused with each other as shown in FIG. 9, and the core portions 25 also were fused. The weight of this long-fiber wad was 0.25 g per meter.

The obtained long-fiber wad was looped and arranged in parallel in one direction. The sheet of the long-fiber wad (40 g) was filled inside ticking of 30 cm (length)×30 cm (width), and the ticking and the long-fiber wad were integrated by sewing, thereby making a stuffed article (pillow). In an observation of the pillow after ten-times of home laundry, the wad was filled uniformly to the four corners and concentration of the wad did not occur.

Comparative Example 1

Unlike Example 1, fixing by sewing was not carried out in this Comparative Example. The stuffed article (pillow) was manufactured by simply filling the ticking with the long-fiber wad without integrally sewing the ticking and the long-fiber wad as in Example 1. In an observation of the pillow after ten-times of home laundry, the wad was concentrated and there was no wad at the four corners.

Example 2

This is a first example where the effect yarn is not a fusible yarn. For the effect yarn 11 shown in FIG. 6, one string of PET multifilament fiber (total fineness: 40 dtex; filament number: 12; trade name "AEROCAPSULE" manufactured by Teijin Limited) and two strings of PET multifilament fiber (total fineness: 33 dtex; filament number: 18; trade name "Silmie" manufactured by Unitika Ltd.) were fed to the waist gauge 13 in a rotating or swinging state. For one example, in a case of swinging, the reciprocation distance was about 40 mm and in a case of rotation, the loop of one side when picked up at the center of the loop was about 20 mm.

For the core yarn 12*a*, two strings of polyester fusible yarn with a trade name "EZBON" manufactured by Woongjin Chemical Co., Ltd. (conjugated multifilament fiber composed of a core of PET and a sheath of polyester copolymer; total fineness: 78 dtex; filament number: 24; straight yarn) and for the core yarn 12*b*, two strings of PET infusible fiber (total fineness: 33 dtex; filament number: 12) were fed to the waist gauge 13. At this time, the yarns were fed so that the core yarns 12*a*, 12*b* would sandwich the loops of the effect yarn 11. Next, the effect yarn 11 and the core yarns 12*a*, 12*b* were twisted together to form the loop yarn 14. The loop yarn 14 was subjected to an actual twisting by the twister 20. The twisting number was 250 per meter. The obtained loop yarn 14 is shown in FIG. 7.

Next, the loop yarn 14 was unwound from the bobbin 17 and thermally treated in the first thermal treatment step 36. The thermal treatment temperature was 170° C. at which the "EZBON" yarn would be fused, and the time for the thermal treatment was about 5 seconds. As a result of this first thermal treatment, the "EZBON" yarn was fused and the loop-like fibers were fused with the core yarns.

The obtained loop yarn 14 was opened in the rubbing-opening step 35. In the rubbing-opening step, two sheets of rubber, woven fabric, unwoven fabric, resin or the like were rubbed with each other so that the loop yarn 14 interposed between the sheets was rubbed and opened to make the loop-like fibers 23 as shown in FIG. 8.

Next, in the silicone-resin spraying step 37, a silicone resin was sprayed on the loop yarn that has been subjected to a fusing process. For the silicone resin, for example, bulky silicone such as "TERON E 530" and soft silicone such as "TERON E 731" and "TERON E 722", all of which are manufactured by Matsumoto Yushi Seiyaku Co., Ltd., were used. The spray amount was 0.5 wt % with respect to the wad as weight in a dried state.

Next, in the second thermal treatment step 38, thermal treatment was carried out at 160° C. for 10 minutes to thermally fix the silicone-treatment agent to the wad. In the obtained long-fiber wad 8, the opened loop-like fibers 23 and the core yarn 22 are thermally fused but not thermally shrunk. This long-fiber wad had a weight of 0.13 g per meter.

The obtained long-fiber wad was looped and arranged in parallel in one direction. The sheet of the long-fiber wad (40 g) was filled inside ticking of 30 cm (length)×30 cm (width), and the ticking and the long-fiber wad were integrated by sewing, thereby making a stuffed article (pillow). In an observation of the pillow after ten-times of home laundry, the wad was filled uniformly to the four corners and concentration of the wad did not occur.

Comparative Example 2

Unlike Example 2, fixing by sewing was not carried out in this Comparative Example. The stuffed article (pillow) was prepared by simply filling the ticking with the long-fiber wad without integrally sewing the ticking and the long-fiber wad as in Example 2. In the observation of the pillow after ten-times of home laundry, the wad was concentrated and there was no wad at the four corners.

Example 3

This is a second example where the effect yarn is not a fusible yarn. For the effect yarn 11, one string of PET multifilament fiber (total fineness: 40 dtex; filament number: 12; trade name "AEROCAPSULE" manufactured by Teijin Limited) and one string of PET multifilament fiber (total fineness: 22 dtex; filament number: 12) were used, and for the core yarn 12*a*, two strings of polyester fusible yarn with a trade name of "EZBON" manufactured by Woongjin Chemical Co., Ltd. (conjugated multifilament fiber composed of a core of PET and a sheath of polyester copolymer; total fineness: 78 dtex; filament number: 24; straight yarn) and for the core yarn 12*b*, two strings of PET infusible yarn (total fineness: 78 dtex, filament number: 24) were used. Along-fiber wad was obtained similarly to Example 2 except for the above-mentioned matter. This long-fiber wad had a weight of 0.21 g per meter.

The obtained long-fiber wad was looped and arranged in parallel in one direction. The sheet of the long-fiber wad (40 g) was filled inside ticking of 30 cm (length)×30 cm (width), and the ticking and the long-fiber wad were integrated by sewing, thereby making a stuffed article (pillow). In an observation of the pillow after ten-times of home laundry, the wad was filled uniformly to the four corners and concentration of the wad did not occur.

Comparative Example 3

Unlike Example 3, fixing by sewing was not carried out in this Comparative Example. The stuffed article (pillow) was prepared by simply filling the ticking with the long-fiber wad without integrally sewing the ticking and the long-fiber wad as in Example 3. In the observation of the pillow after ten-times of home laundry, the wad was concentrated and there was no wad at the four corners.

Example 4

This is a third example where the effect yarn is not a fusible yarn. For the effect yarn 11, one string of PET infusible yarn (total fineness: 280 dtex; filament number: 24) and one string of PET multifilament fiber (total fineness: 22 dtex; filament number: 12) were used, and for the core yarn 12*a* and the core yarn 12*b*, respectively two strings (four in total) of "MELSET" (trade name) manufactured by Unitika Ltd. (conjugated multifilament fiber composed of a core of PET and a sheath of polyester copolymer; total fineness: 167 dtex; filament number: 48; straight yarn) were used. Along-fiber wad was obtained similarly to Example 2 except for the above-mentioned matter. The long-fiber wad had a weight of 0.96 g per meter.

The obtained long-fiber wad was looped and arranged in parallel in one direction. The sheet of the long-fiber wad (40 g) was filled inside ticking of 30 cm (length)×30 cm (width), and the ticking and the long-fiber wad were integrated by sewing, thereby making a stuffed article (pillow). In an observation of the pillow after ten-times of home laundry, the wad was filled uniformly to the four corners and concentration of the wad did not occur.

Comparative Example 4

Unlike Example 4, fixing by sewing was not carried out in this Comparative Example. The stuffed article (pillow) was prepared by simply filling the ticking with the long-fiber wad without integrally sewing the ticking and the long-fiber wad as in Example 4. In the observation of the pillow after ten-times of home laundry, the wad was concentrated and there was no wad at the four corners.

Example 5

This is a first example where a long-fiber wad is formed of an air-entangled yarn. For both the core yarn and the effect yarn, "EZBON" (trade name) manufactured by Woongjin Chemical Co., Ltd. (a conjugated multifilament fiber composed of a core of PET and a sheath of polyester copolymer; total fineness: 78 dtex; filament number: 24; straight yarn) was used. Respectively two strings of the yarn were fed to two feed rollers of an air-entanglement device, which were subjected to a combining-entangling treatment with an entanglement nozzle having an air pressure of 0.4 MPa at a core yarn feeding rate of 50 m/min., an effect yarn feeding rate of 800 m/min., and a winding rate of 55 m/min. Subsequently, the conjugated yarn having passed through a delivery roller was wound around a bobbin equipped with a ring-twisting mechanism, so that an air-entangled yarn was obtained.

The thus obtained loop yarn (air-entangled yarn) was unwound from the bobbin and opened in the rubbing-opening step shown in FIG. 5. In the rubbing-opening step, two sheets of rubber, woven fabric, unwoven fabric, resin or the like were rubbed with each other so that the loop yarn interposed between the sheets was rubbed and opened.

Next, in the silicone resin spraying step, a silicone resin was sprayed. For the silicone resin, an aqueous solution of a mixture of three kinds of silicone, i.e., bulky silicone such as "TERON E 530" and soft silicone such as "TERON E 731" and "TERON E 722", all of which are manufactured by Matsumoto Yushi Seiyaku Co., Ltd., were used. The amount of the spray was 3.0 wt % with respect to the wad as weight in a dried state. Next, in the thermal treatment step, a thermal treatment was carried out at 140 to 190° C. for 1 to 10 minutes, thereby the silicone resin was cured and at the same time the core yarn and the effect yarn were fused and fixed.

In the obtained long-fiber wad, the fibers composing the core yarn 42 and the effect yarn 41 were entangled with each other, the effect yarn 41 was opened to partly form loop-like fibers, and the effect yarn 41 that had been opened and partly forming the loop-like fibers were fused with each other, and the core yarn 41 also was fused. This long-fiber wad had weight of 0.18 g per meter.

The obtained long-fiber wad was looped and arranged in parallel in one direction. The sheet of the long-fiber wad (40 g) was filled inside ticking of 30 cm (length)×30 cm (width), and the ticking and the long-fiber wad were integrated by sewing, thereby making a stuffed article (pillow). In an observation of the pillow after ten-times of home laundry, the wad was filled uniformly to the four corners and concentration of the wad did not occur.

Comparative Example 5

Unlike Example 5, fixing by sewing was not carried out in this Comparative Example. The stuffed article (pillow) was prepared by simply filling the ticking with the long-fiber wad without integrally sewing the ticking and the long-fiber wad as in Example 5. In the observation of the pillow after ten-times of home laundry, the wad was concentrated and there was no wad at the four corners.

Example 6

This is a second example where a long-fiber wad is formed of an air-entangled yarn. For the core yarn, a PET multifilament fiber (total fineness: 33 dtex; filament number: 18; trade name "Silmie" manufactured by Unitika Ltd.) was used, and for the effect yarn, a PET multifilament fiber (total fineness: 40 dtex; filament number: 12; trade name "AERO-CAPSULE" manufactured by Teijin Limited) was used. Each one string of these yarns was fed to two feed rollers of an air-entanglement device, and the yarns were subjected to a combining-entangling treatment with an entanglement nozzle having an air pressure of 0.4 MPa at a core yarn feeding rate of 50 m/min., an effect yarn feeding rate of 800 m/min., and a winding rate of 55 m/min. Subsequently, the conjugated yarn having passed through a delivery roller was wound around a bobbin equipped with a ring-twisting mechanism, so that an air-entangled yarn was obtained.

The obtained loop yarn (air-entangled yarn) was opened at the same time of air entanglement to a degree not to cause any substantial problem in use.

Next, in the silicone-resin spraying step, a silicone resin was sprayed. For the silicone resin, an aqueous solution of a mixture of three kinds of silicone, i.e., bulky silicone such as "TERON E 530" and soft silicone such as "TERON E 731" and "TERON E 722", all of which are manufactured by Matsumoto Yushi Seiyaku Co., Ltd., were used. The amount of the spray was 3.0 wt % with respect to the wad as weight in a dried state. Next, in the thermal treatment step, a thermal treatment was carried out at 140 to 190° C. for 1 to 10 minutes, and thereby the silicone resin was cured.

In the obtained long-fiber wad, the fibers composing the core yarn 42 and the effect yarn 41 were entangled with each other and thus integrated, and the effect yarn 41 was opened to partly form loop-like fibers. No fusion was found. This long-fiber wad had weight of 0.01 g per meter.

The obtained long-fiber wad was looped and arranged in parallel in one direction. The sheet of the long-fiber wad (40 g) was filled inside ticking of 30 cm (length)×30 cm (width), and the ticking and the long-fiber wad were integrated by sewing, thereby making a stuffed article (pillow). In an observation of the pillow after ten-times of home laundry, the wad was filled uniformly to the four corners and concentration of the wad did not occur.

Comparative Example 6

Unlike Example 6, fixing by sewing was not carried out in this Comparative Example. The stuffed article (pillow) was prepared by simply filling the ticking with the long-fiber wad without integrally sewing the ticking and the long-fiber wad as in Example 6. In the observation of the pillow after ten-times of home laundry, the wad was concentrated and there was no wad at the four corners.

The results in the above Examples 1-6 and Comparative Examples 1-6 are illustrated in Table 1 below and in FIGS. 11-16.

TABLE 1

Figure 11:
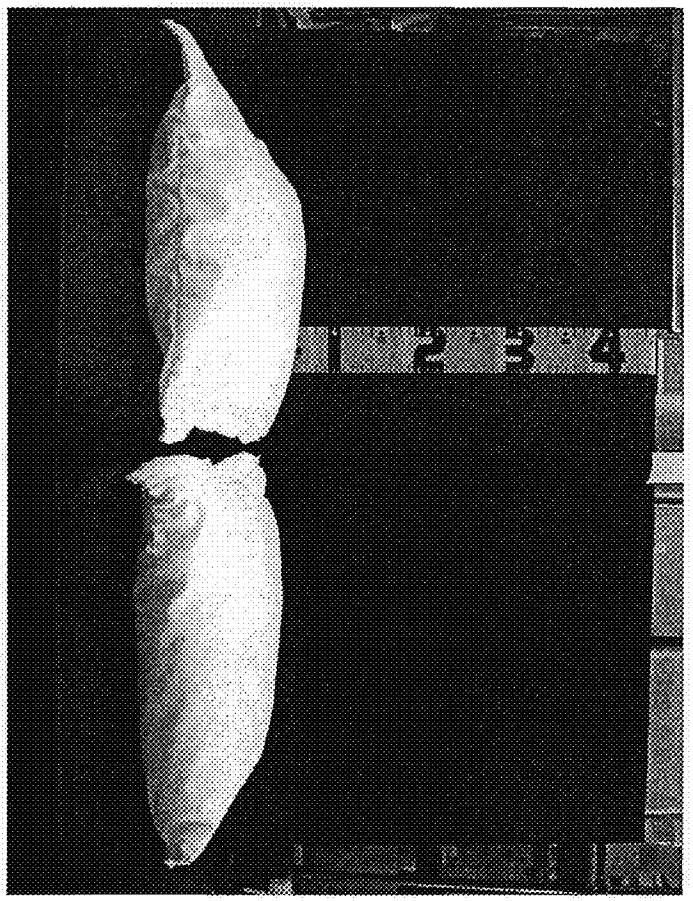
FIG. 11 is a photograph for comparison after a washing test between a stuffed article of Example 1 of the present invention and a stuffed article of Comparative Example 1.
Figure 12:
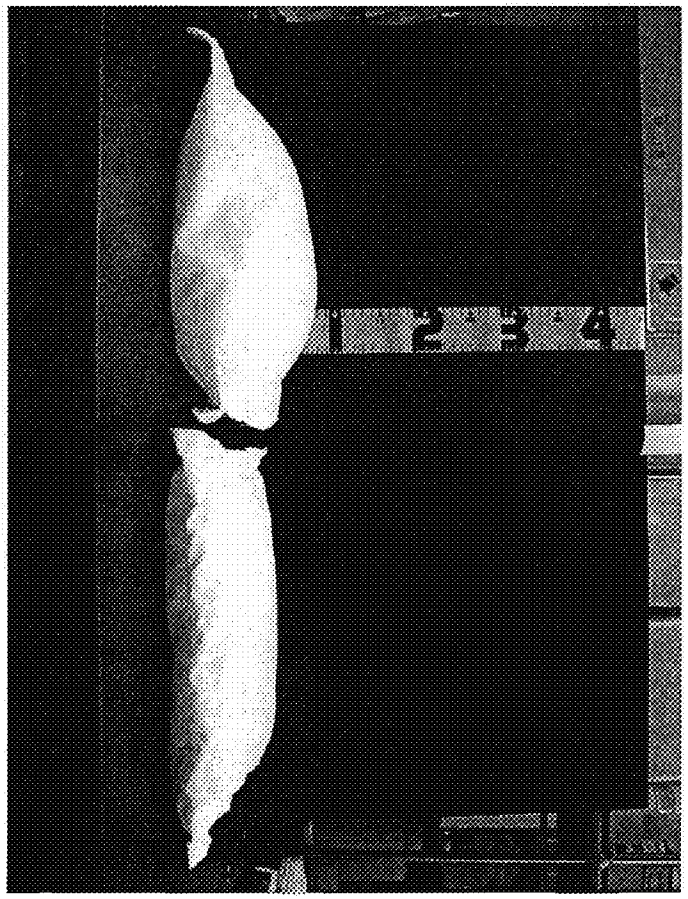
FIG. 12 is a photograph for comparison after a washing test between a stuffed article of Example 2 of the present invention and a stuffed article of Comparative Example 2.
Figure 13:
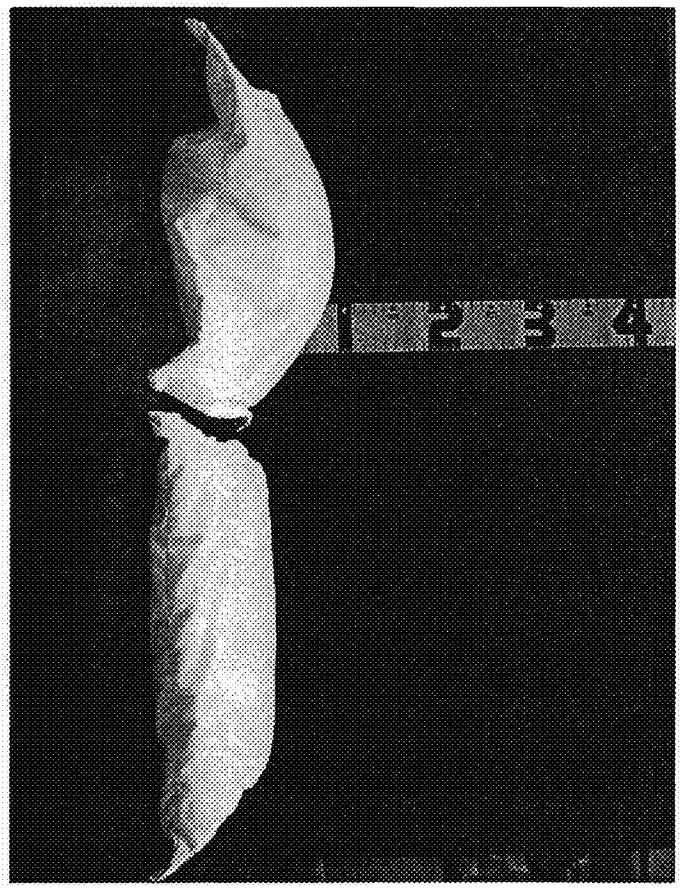
FIG. 13 is a photograph for comparison after a washing test between a stuffed article of Example 3 of the present invention and a stuffed article of Comparative Example 3.
Figure 14:
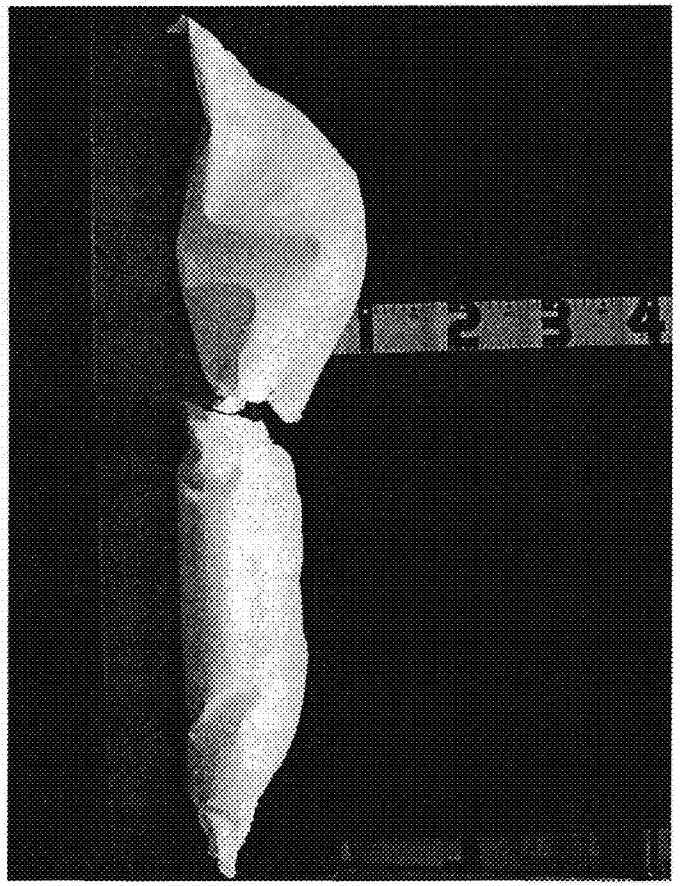
FIG. 14 is a photograph for comparison after a washing test between a stuffed article of Example 4 of the present invention and a stuffed article of Comparative Example 4.
Figure 15:
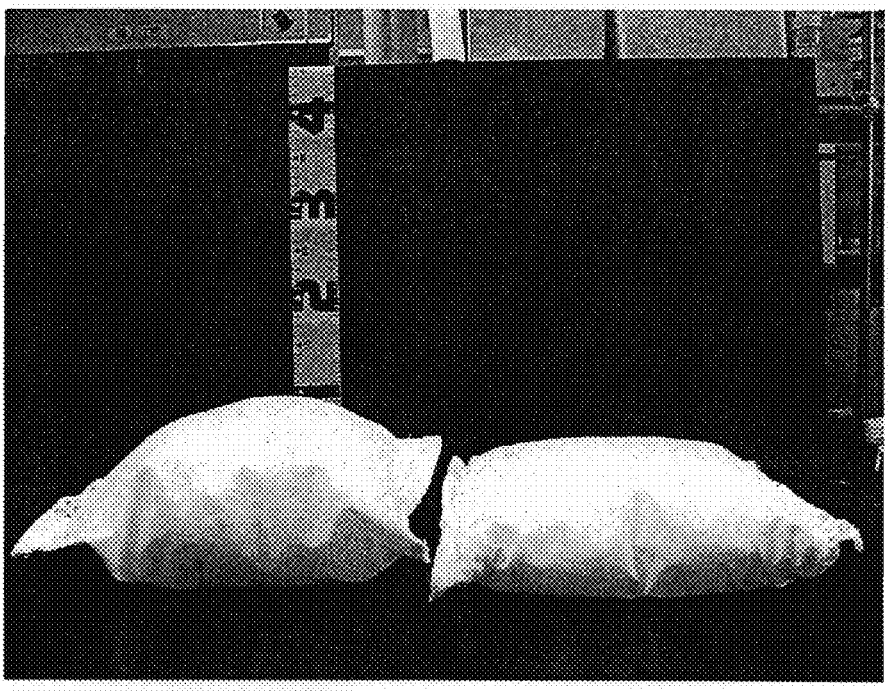
FIG. 15 is a photograph for comparison after a washing test between a stuffed article of Example 5 of the present invention and a stuffed article of Comparative Example 5.
Figure 16:
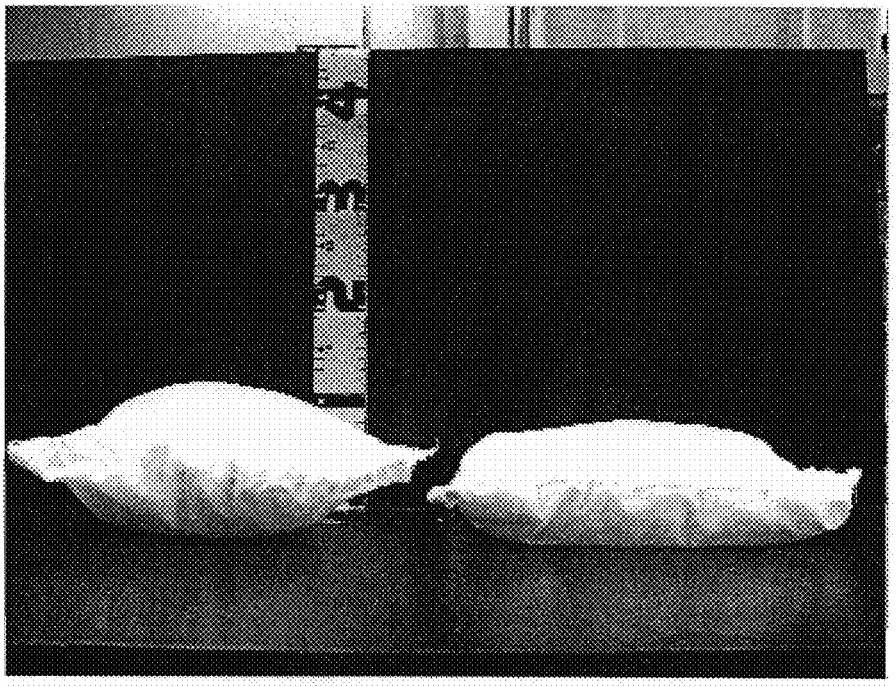
FIG. 16 is a photograph for comparison after a washing test between a stuffed article of Example 6 of the present invention and a stuffed article of Comparative Example 6.

| Stuffed article No. | Size of stuffed article Length × width (fill amount) | Fixing at both ends of long-fiber wad | Evaluation after ten-times of home laundry | Drawing |
|---|---|---|---|---|
| Example 1 | 30 cm × 30 cm (40 g) | Fixed | Uniformly filled, no concentration | FIG. 11, right |
| Comparative Example 1 | 30 cm × 30 cm (40 g) | Not fixed | Ununiformly filled, concentrated | FIG. 11, left |
| Example 2 | 30 cm × 30 cm (40 g) | Fixed | Uniformly filled, no concentration | FIG. 12, right |
| Comparative Example 2 | 30 cm × 30 cm (40 g) | Not Fixed | Ununiformly filled, concentrated | FIG. 12, left |
| Example 3 | 30 cm × 30 cm (40 g) | Fixed | Uniformly filled, no concentration | FIG. 13, right |
| Comparative Example 3 | 30 cm × 30 cm (40 g) | Not fixed | Ununiformly filled, concentrated | FIG. 13, left |
| Example 4 | 30 cm × 30 cm (40 g) | Fixed | Uniformly filled, no concentration | FIG. 14, right |
| Comparative Example 4 | 30 cm × 30 cm (40 g) | Not Fixed | Ununiformly filled, concentrated | FIG. 14, left |
| Example 5 | 30 cm × 30 cm (40 g) | Fixed | Uniformly filled, no concentration | FIG. 15, right |
| Comparative Example 5 | 30 cm × 30 cm (40 g) | Not fixed | Ununiformly filled, concentrated | FIG. 15, left |
| Example 6 | 30 cm × 30 cm (40 g) | Fixed | Uniformly filled, no concentration | FIG. 16, right |
| Comparative Example 6 | 30 cm × 30 cm (40 g) | Not fixed | Ununiformly filled, concentrated | FIG. 16, left |

As mentioned above, in all of Examples 1-6, the long-fiber wad is filled uniformly to the four corners of the ticking even after ten-times of home laundry, and no concentration occurred. In contrast, in Comparative Example 1-6, the long-fiber wad was displaced to the center of the ticking and the center was swollen while there was no wad remaining at the four corners of the ticking and the corner areas were flattened.

Example 7

The present example refers to a comforter. The long-fiber wad obtained in Example 1 was looped and arranged in parallel in one direction, which was made into a sheet by sewing and fixing at the both ends by using a narrow ribbon 1 cm in width as shown in FIG. 4. This sheet of long-fiber wad 1.6 kg in weight was filled in the width direction inside the ticking 210 cm in length and 150 cm in width, and provided with seam lines as shown in FIG. 1 so as to provide a comforter. In an observation of the comforter after five-times of linen laundry, the wad was filled uniformly to the four corners, and no concentration occurred.

It was confirmed from the above recitation that the article in each example of the present invention maintains the bulkiness and that its wash resistance is improved. Namely, in the stuffed article of the present invention, since the long-fiber wad is fixed to the ticking and since the effect yarn is integrated with the core yarn, the displacement of the long-fiber wad is limited even after repeated washing, and thus the wad is less concentrated and the stuffed article has high bulkiness Explanation of Letters and Numerals

1 comforter/quilt
2*a*,2*b* ticking
3 pillow
4,5,6,7*a*-7*c* seam line
8,40 long-fiber wad
9 long-fiber wad sheet
10*a*,10*b* ribbon-like strip
11,31,41 effect yarn
12*a*,12*b*,22,32,42 core yarn
13,33 waist gauge
14 loop yarn
15 motor
16 belt
17 bobbin
18 ring
19 traveler
20 twister
23 loop-like fiber
24 fused portion
25 core portion
34 twisting step
35 rubbing-opening step
36 first thermal treatment step
37 silicone-resin spraying step
38 second thermal treatment step

The invention claimed is:

1. A stuffed article, comprising:

a ticking filled with a stuffing, wherein the stuffing comprises a long-fiber wad comprising an effect yarn and a core yarn air-entangled and integrated with each other, wherein the effect yarn is opened to form loop-like fibers;

a weight ratio of the effect yarn to the core yarn and the effect yarn together is 80 to 99% by weight(wt %), and a plurality of strings of the long-fiber wad are arranged in parallel in at least one direction and sewn to the ticking such that the strings are integrated with the ticking.

2. The stuffed article according to claim 1, wherein the long-fiber wad has a weight per unit length of 0.05 to 1.5 g/m.

3. The stuffed article according to claim 1, wherein the effect yarn and the core yarn comprise at least one infusible fiber selected from the group consisting of a polyester fiber, a nylon fiber, and a polypropylene fiber.

4. The stuffed article according to claim 1, wherein the stuffed article is at least one selected from the group consisting of a comforter/quilt, a blanket, a sleeping bag, a pillow, a cushion, a mat, a stuffed toy, a leg sheet, a jacket, pants, a vest, a coat, cold-protection clothing, and a neck-warmer.

5. The stuffed article according to claim 1, wherein the long-fiber wad has a weight per unit length of 0.01 to 3 g/m.

6. The stuffed article according to claim 1, wherein the effect yarn and the core yarn are not fused.

7. The stuffed article according to claim 1, wherein a silicone-treatment agent is fixed by heat to the long-fiber wad.

8. The stuff article according to claim 7, wherein an amount of silicone-treatment agent adhered is in a range of 0.1 to 10 wt % with respect to a total weight of the effect yarn and the core yarn in a dried state.

9. A method for manufacturing a stuffed article having a ticking filled with a stuffing, the method comprising:

twisting an effect yarn and a core yarn and opening loop-like fibers of the effect yarn so as to form a long-fiber wad, or subjecting an effect yarn and a core yarn to a combining-entangling treatment with an air-entanglement device and opening the effect yarn as required so as to form a long-fiber wad, wherein a weight ratio of the effect yarn to the core yarn and the effect yarn together is 80 to 99% by weight (wt %); and arranging a plurality of strings of the long-fiber wad in parallel in at least one direction and sewing to the ticking to be integrated with the ticking.

10. The method for manufacturing a stuffed article according to claim 9, wherein the long-fiber wad has a weight per unit length of 0.05 to 1.5 g/m.

11. The method for manufacturing a stuffed article according to claim 9, wherein the effect yarn and the core yarn comprise at least one infusible fiber selected from the group consisting of a polyester fiber, a nylon fiber, and a polypropylene fiber.

12. The method for manufacturing a stuffed article according to claim 9, wherein the stuffed article is at least one selected from the group consisting of a comforter/quilt, a blanket, a sleeping bag, a pillow, a cushion, a mat, a stuffed toy, a leg sheet, a jacket, pants, a vest, a coat, cold-protection clothing, and a neck-warmer.

13. The method for manufacturing the stuffed article according to claim 9, wherein the effect yarn and the core yarn are not fused.

14. The method for manufacturing the stuffed article according to claim 9, wherein a silicone-treatment agent is sprayed on the long-fiber wad and a thermal treatment is carried out.

15. The method for manufacturing the stuffed article according to claim 14, wherein an amount of the sprayed silicone-treatment agent is in a range of 0.1 to 10 wt % with respect to a total weight of the effect yarn and the core yarn in a dried state.

* * * * *